US007690144B2

(12) United States Patent
Fagundes de Campos

(10) Patent No.: US 7,690,144 B2
(45) Date of Patent: Apr. 6, 2010

(54) SAFETY DEVICE FOR SHOOT. .ING MECHANISM OF DOUBLE-ACTION SEMI-AUTOMATIC STRIKER FIRED PISTOLS

(75) Inventor: Algeu Jose Fagundes de Campos, Porte Alegre (BR)

(73) Assignee: Forjas Taurus, S.A., Porto Alegre (BR)

( * ) Notice: Subject to any disclaimer, the term of this patent is extended or adjusted under 35 U.S.C. 154(b) by 879 days.

(21) Appl. No.: 10/838,565

(22) Filed: May 4, 2004

(65) Prior Publication Data

US 2005/0011098 A1 Jan. 20, 2005

(30) Foreign Application Priority Data

May 23, 2003 (BR) ..... 0301483

(51) Int. Cl.
*F41A 9/61* (2006.01)

(52) U.S. Cl. ..... 42/7; 42/69.02; 42/70.04; 42/70.02; 42/70.05; 42/70.08; 89/147

(58) Field of Classification Search ..... 42/70.04, 42/70.01, 70.05, 70.08, 7, 69.02, 70.02; 89/147
See application file for complete search history.

(56) References Cited

U.S. PATENT DOCUMENTS 5,355,768 A * 10/1994 Felk ..... 89/147
5,363,581 A * 11/1994 Blenk et al. ..... 42/69.02
5,438,784 A * 8/1995 Lenkarski et al. ..... 42/70.02
5,697,178 A * 12/1997 Haskell ..... 42/70.04
6,308,449 B1 * 10/2001 Plebani ..... 42/70.08
6,560,909 B2 * 5/2003 Cominolli ..... 42/70.05

* cited by examiner

*Primary Examiner*—Michelle (Shelley) Clement
(74) *Attorney, Agent, or Firm*—Bachman & LaPointe, P.C.

(57) ABSTRACT

Safety Device for a Shooting Mechanism of Double-Action Semi-Automatic Pistols Striker Fired The present application refers to a safety device for a shooting mechanism of semi-automatic guns, more specifically double action semi-automatic pistols striker fired, composed of a trigger support, a trigger body, a hinging axle for the two components, a small spring that acts between them and a trigger bar joined to the body of the trigger, with the addition of a firing pin lock located besides the front part of it and lodged in the breech-block.

5 Claims, 7 Drawing Sheets

SAFETY DEVICE FOR SHOOTING MECHANISM OF DOUBLE-ACTION SEMI-AUTOMATIC STRIKER FIRED PISTOLS

FIELD OF THE INVENTION

The application refers to a safety device for a shooting mechanism of semiautomatic pistols, more specifically for double-action semi-automatic striker fired pistols.

BACKGROUND OF THE INVENTION

Double-action semi-automatic striker fired pistols had as their precursor and paragon the Austrian Glock company model, whose structure and handle are made of plastic and solely shoots in double action striker fired manner.

To assure the safe use of the gun, a small-hinged lever protruding from the front of the trigger was added and should be previously pressed to release its movement. Therefore, only upon deliberate action over the trigger, the forefinger automatically deactivates its lock and cause the gun to shoot.

Said trigger lock of this kind of pistol, which constitutes an additional component not traditional for pistols, was in fact added to avoid the occurrence of accidental firing if the gun at issue falls, hitting its end portion on a hard surface. Shooting occurs when the intensity of the impact forces the firing mechanism, including the firing pin, to come back by inertia, thus pressing the respective springs hard enough to cause, when returning, the percussion of the cartridge within the chamber.

The market success of this kind of gun led other foreign manufacturers to adopt the same type of gun with variants of the trigger lock system, as we can see in the models: Steyr M 40, Walther P99, Smith & Wesson 40F and Springfield XD, including this applicant, who also developed an original gun model provided with innovations in the shooting system, as per patent PI 9700178-3, also provided with a safety system against accidental shots whose purpose is equivalent to that of the Glock company.

To optimize production and performance, the present safety device, object of this application, was developed, consisting in a modification of the trigger of said patent PI 9700178-3, which should be considered as a reference in the present description.

The trigger, previously constituted of a single piece, is currently composed of a trigger support, its body, a hinging axle for the two components, a small spring acting between them and a lock of the trigger bar to the body of the trigger. Additionally, a firing pin lock was added, located beside its front portion and stored in the breechblock.

DESCRIPTION OF DRAWINGS

The present invention can be better understood in the light of the description made with reference to the attached figures given as a non-limitative example, in which.

DETAILED DESCRIPTION OF THE INVENTION

Figure 6:
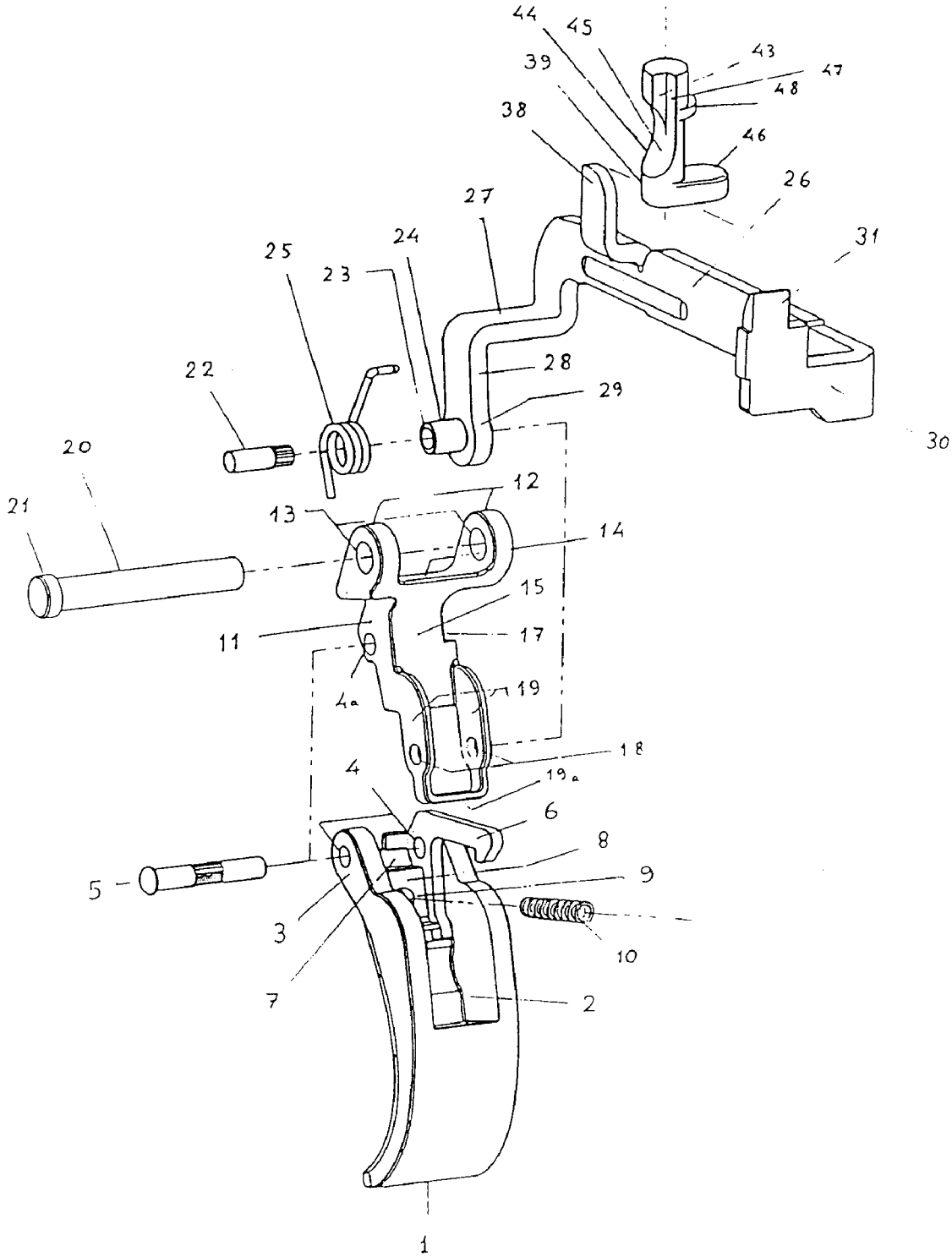
FIG. 6 is an exploded perspective view of the components of the shooting mechanism, except for the insert and the firing pin.

The safety device of the shooting mechanism object of this patent, is constituted of a trigger model that substitutes that of patent 9700178-3 and that can be easily described based on FIG. 6, in which it is clear that the sole body of the trigger of model PI 9700178-3 has now been substituted for a hinged set of parts.

As the first component of said hinged set, we have the trigger support (11). Said metal support is made of MIM (metal injection molding), and constituted of a main body (15) limited on top by a bar (14), whose ends are turned upwards, forming two rounded vertical wings (12).

Concentrically to the curved part of said wings, there are holes (13) to bear the axle (20), when it is already inserted into the respective lodgings of the insert (49).

Figure 7:
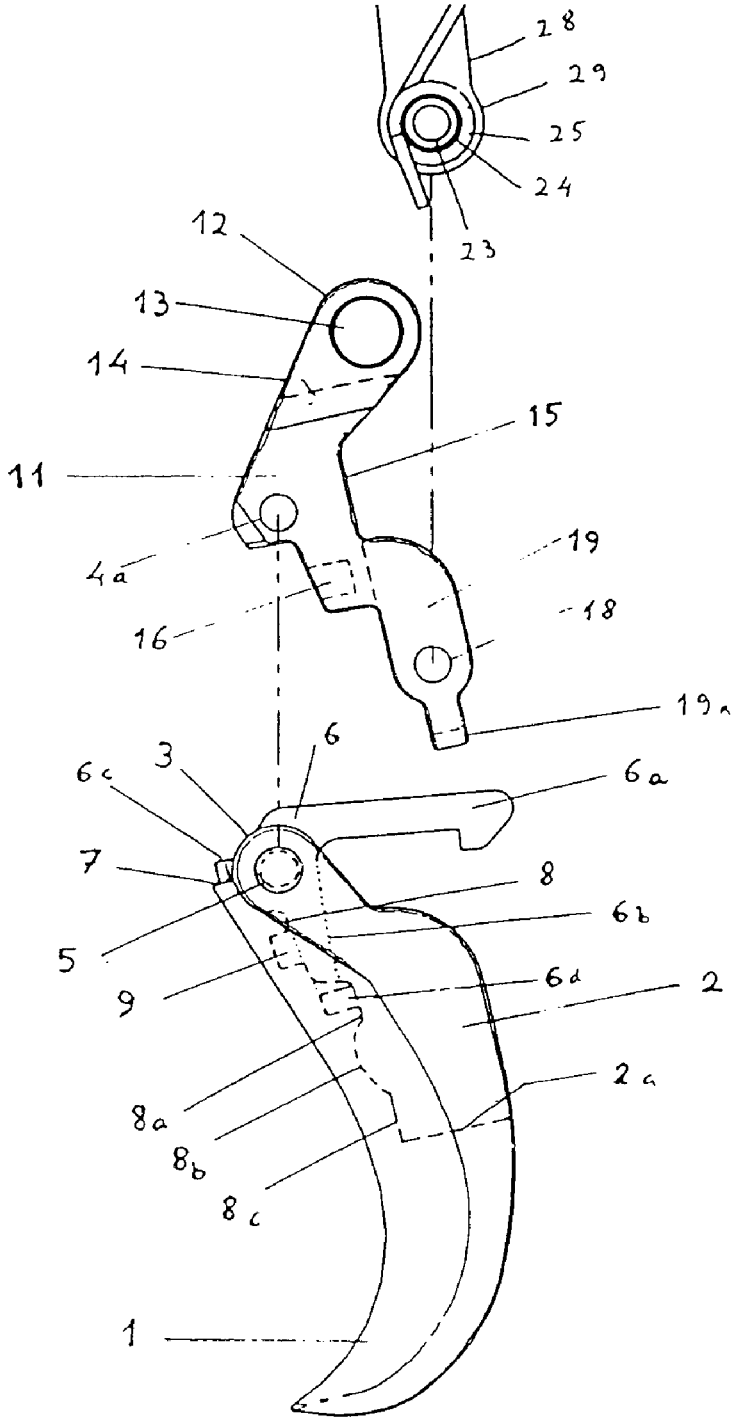
FIG. 7 is a side view of the trigger support and the trigger body.

The rear face of the trigger body (15) support (11) is a plane, and it curves backwards on top to the inclined plane that comprises the rear face of the bar (14), and is tangent to the start of the round contour of the wings (12), FIG. 7.

The front face of the highest part of the support (11) is also inclined in continuation of the two plane front faces, tangent to the rounded higher contour of the wings (12).

Said plane and inclined portion of the front face is then curved downwards and slightly backwards, to intercept a small horizontal face limited by a slightly converging plane in relation to the rear face of the body (15). The plane at issue extends to the also horizontal face which limits the lower portion of the body (15), FIG. 7.

The two lateral and parallel faces of the body (15) of the trigger support (11) are connected by the hole (4*a*); which is practically concentric to the curved portion of the front contour of said support. The axle (5) will be introduced in that hole and serve as a hinge to the body of the trigger (1). On the right side face of the body (15), there is a plane depression (17) to lodge the plate (6) of the trigger lock.

From the rear part of the body (15) of the trigger support (11), two thin wings (19) project as a continuation of the planeside faces of said body. The wings (19) have identical contour and are joined in the lower portion by a stirrup (19*a*). The contour of the wings (19) starts in this upper part by a curved rear part corresponding to the portion where they are joined to the body (15). Afterwards, said contour is formed by two edges parallel to the rear face of said body, which come down to the lower circular portion, interrupted in the middle by the narrow extension that constitutes the stirrup (19*a*) joining said wings (19). Concentric to these lower circular portions, there are holes (18) to lodge the hinging pin (22) with the bushing (24) of the trigger bar (26).

Figure 8:
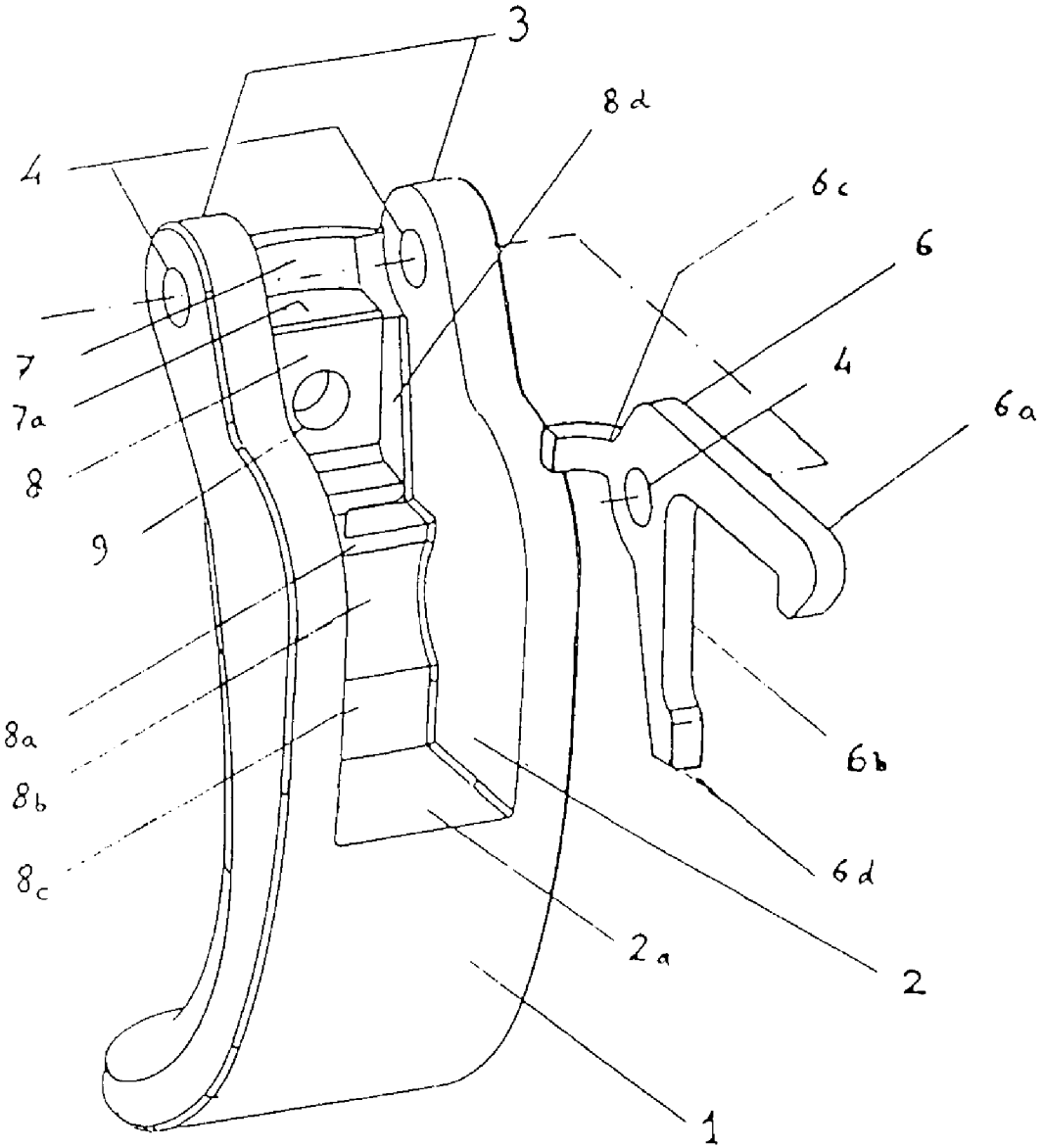
FIG. 8 is a perspective view of the trigger body and the coupling rod lock.

The trigger itself (1) is formed by a plastic body, similar to the trigger portion (PI 9700178-3) which is projected below the insert (49). Said body (1) is provided with two parallel side wings (3) in its higher portion, whose thickness defines that of the side walls of the recess (2) that constitutes the lodging of the lower part of the trigger support (11). See FIGS. 6, 7 and 8.

The bottom of said recess (2) is constituted of a complex surface defined by a successive series of faces with different shapes. That surface starts in its higher portion by a small curved face (7), with inclined generatrix, whose higher plane edge constitutes the support for the small curved front arm (6*d*) of the lock (6). The small curved portion (7) is limited in its lower portion by a plane face (7*a*), which is projected backwards and bends downwards, forming a plane rectangular face (8).

The curved front protuberance of the trigger support (11) will be lodged the small cavity constituted in the higher part of the recess (2) of the trigger (1), said protuberance cut below by a small plane face.

In the middle of the rectangular plane face (8), there is a hole (9) to lodge the front portion of the small spring (10), whose rear end will also lodge in the hole (16) of the front face of the body (15) of the trigger support (11).

The rectangular plane face (8), in its lower portion, bends backwards in a small and slightly inclined portion which, on the other hand, is bent downwards, forming a narrow vertical face (8*a*), followed by a cylindrical concave surface (8*b*) that separates it from the also vertical face (8*c*) ending the complex surface that constitutes the bottom of the recess (2), limited in its lower part by the horizontal face (2*a*).

On the right side, both from the small curved face (7) and the plane rectangular face (8), where both would intercept the side wall of the recess (2), there is an incision (8*d*), that runs downwards to reach the higher part of the second vertical portion (8*a*), where the incision (8*d*) turns left.

The purpose of said incision (8*d*) is to lodge, firmly fit inside it, the trigger look plate, from its wider part (6) provided with a hole (4), which will be aligned with the holes (4) of the wings (3), to its vertical arm (6*b*) including its lower end (6*d*).

After assembly the gun support (11) inside the recess (2) of the trigger body (1), the axle (5) is inserted in the holes (4), which will cause the plate (6) of the trigger lock to be definitively fixed to it, both forming practically a single piece.

From the wider part of the lock (6), a rectangular arm (6*a*), practically perpendicular to the lower projection (6*b*), projects backwards. From the round end edge of the arm (6*a*), a fastener projects downside, intended to engage the horizontal stirrup (27) of the trigger bar.

The trigger bar (26) that work assembled in the insert (49) has the front portion of the main shaft (26) curved downside and, afterwards bent inside, forming a small horizontal stirrup (27) which, is bent downside, forming the vertical projection (28), whose lower round portion (29) has the bush (24) with the hole (23) concentrically fit and fixed in it.

Said bush (24) is surrounded by the return spring (25) of the trigger, whose longer arm turned upwards acts on the rear edge of the vertical projection (28) of the trigger bar (26) and whose shorter arm turned downward, acts on the rear edge of the stirrup (19*a*) of the wings (19).

The vertical projection (28), with the spring (25) already surrounding its bush (24), will be introduced vertically in the gap between the wings (19) of the trigger support (11) to an alignment position between their holes (18) and the through hole (23) of the bush (24). This position will be maintained by the introduction in said holes of the axle (22), whose edges will be aligned with the external side faces of the wings (19).

After checking the correct position of the small spring (10) in relation to their lodging holes (9) and (16), respectively located on the face (8) of the trigger (1) and the front face of the body (15) of its support (11), this will be inserted from behind in the recess (2) of the trigger (1).

This insertion will be made until the alignment between the holes (4) of the wings (3) of the trigger (1) and the hole (4*a*) of the body (15) of the respective support (11) is reached, thus making it possible to introduce the axle (5) in said holes, by effecting the hinged union of these two components.

The main element of this patent is therefore assembled; which is the hinged trigger with its lock and the firing pin lock.

Afterwards, the hinged trigger support (11) is lodged in the insert (49); in which it will be pivotally mounted, by its main axle (20), inserted both in the holes of the walls of said insert and the holes (13) of said support (11).

As previously described, the trigger bar (26) is hinged to the trigger support (11) by means of the round lower portion (29), the lower protuberance (28) and said trigger bar, whose bush (24) will bear the pin (22), also lodged in both holes (18) of the wings (19). The main part of the trigger bar is constituted of its horizontal shaft (26), which, almost from its beginning, presents on it higher edge a small protuberance bent inwards and then upwards, forming the tip of the command (38) of the lock (39) of the firing pin (32).

In the rear edge, the shaft (26) of the trigger bar is bent vertically inwards, being ended by a portion projecting upwards, constituting the fastener (31) of said coupling rod. Said fastener (31) is rounded in the front of its higher edge, to facilitate fitting in the lower protuberance (33) of the firing pin (32), which has the rear portion of the lower edge also rounded with the same purpose.

The lock (39) of the firing pin (32) is lodged in a cavity (41) of the breechblock (40), which is adjacent to and intercepts the front portion of the passing hole of said firing pin.

The lock (39) is usually pressed downwards of its enclosure (41) by its spring (42) and its exit is inhibited by the action of the breechblock component over the side protuberance (47) of the lock. The lower end of the lock body (39) is perpendicularly bent to the right of the breechblock (40), to be activated upwards by the command (38) of the trigger bar when this is retreated, reaching the shooting position.

In this upward position, the lock (39) of the firing pin will have the cylindrical face of said side recess (45) aligned with the cylindrical external surface of the firing pin (32), since they have the same axle. Thus, the firing pin is released, allowing its advance for percussion.

After describing the main elements of the firing system, whose main innovation is constituted of the hinged trigger, an explanation of the operation of said system will be presented.

Figure 1:
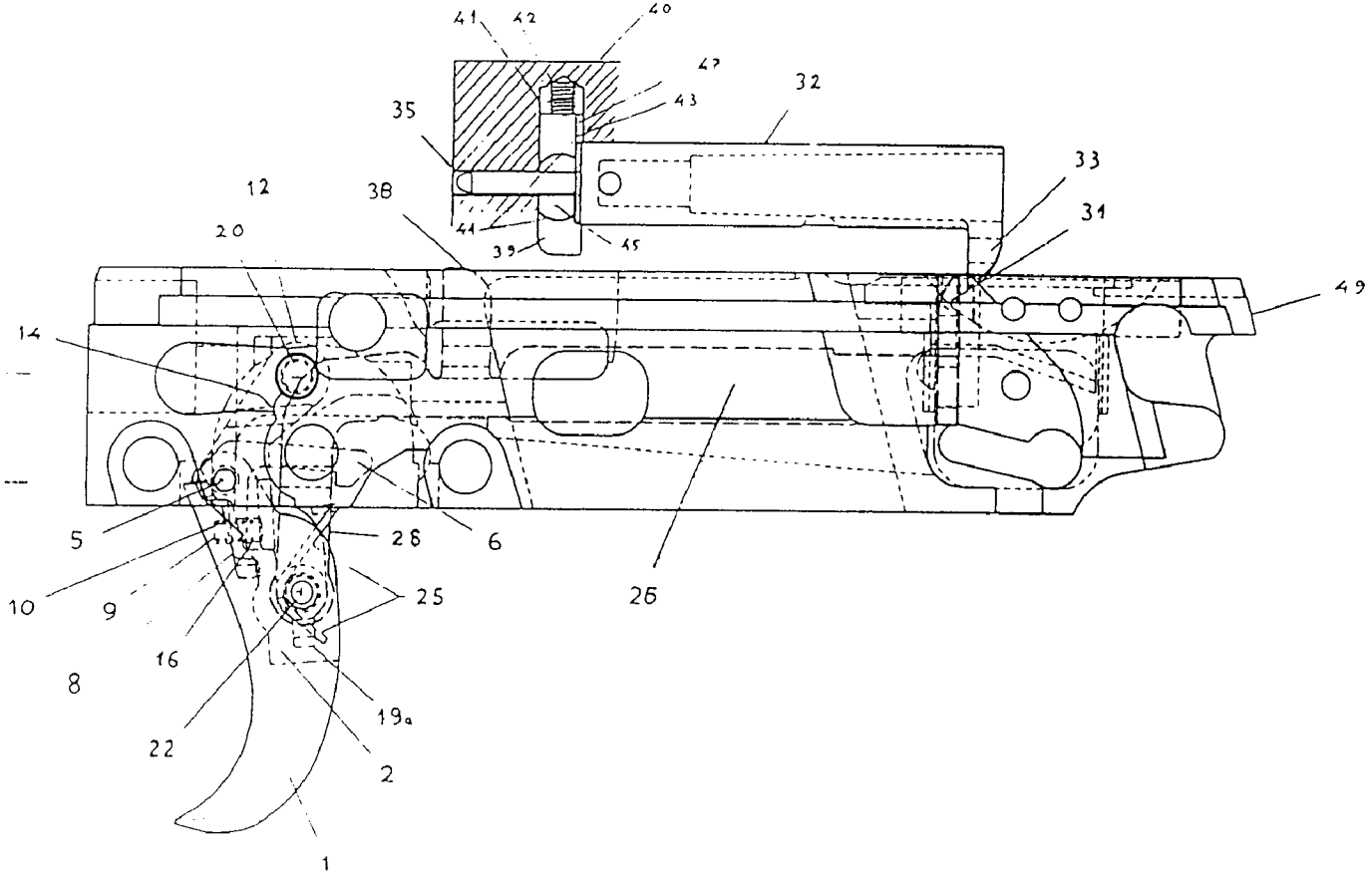
FIG. 1 is a side view of the structure insert, which lodges the components of the shooting mechanism, including a schematic representation of the firing pin which in fact is lodged inside the breechblock, not represented in detail.

FIG. 1 represents the shooting system as kept in the insert (49) of the structure in a resting position of the trigger (1) in relation to the firing pin (32).

Figure 2:
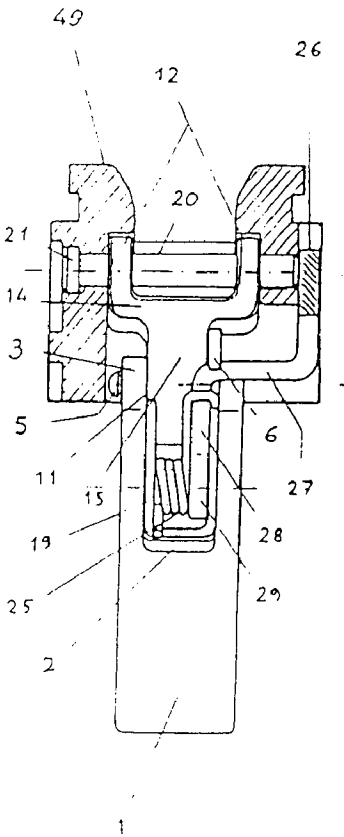
FIG. 2, left from FIG. 1, represents an end view of the mechanism at issue as inserted in a schematic section of said insert.

FIG. 2 represents a rear view of said system, clearly showing the relative position of its components, such as the lock fastener (6), engaging the rear edge of the stirrup (27) of the trigger bar (26) and the adjusted insertion of the lower round portion (29) and respective bush (24), the vertical projection (28) of said trigger bar (26), in the space between the wings (19). The position of the spring (25), involving the bush (24) is clear, acting with its longer right arm engaged to the higher part of the rear edge of the protuberance (28) of the trigger bar and its shorter left arm, acting on the rear edge of the stirrup (19*a*) of the wings (19) of the trigger support (11). The lock (39) of the firing pin (32) is maintained downwards by the spring (42), that impedes its advance.

Figure 3:
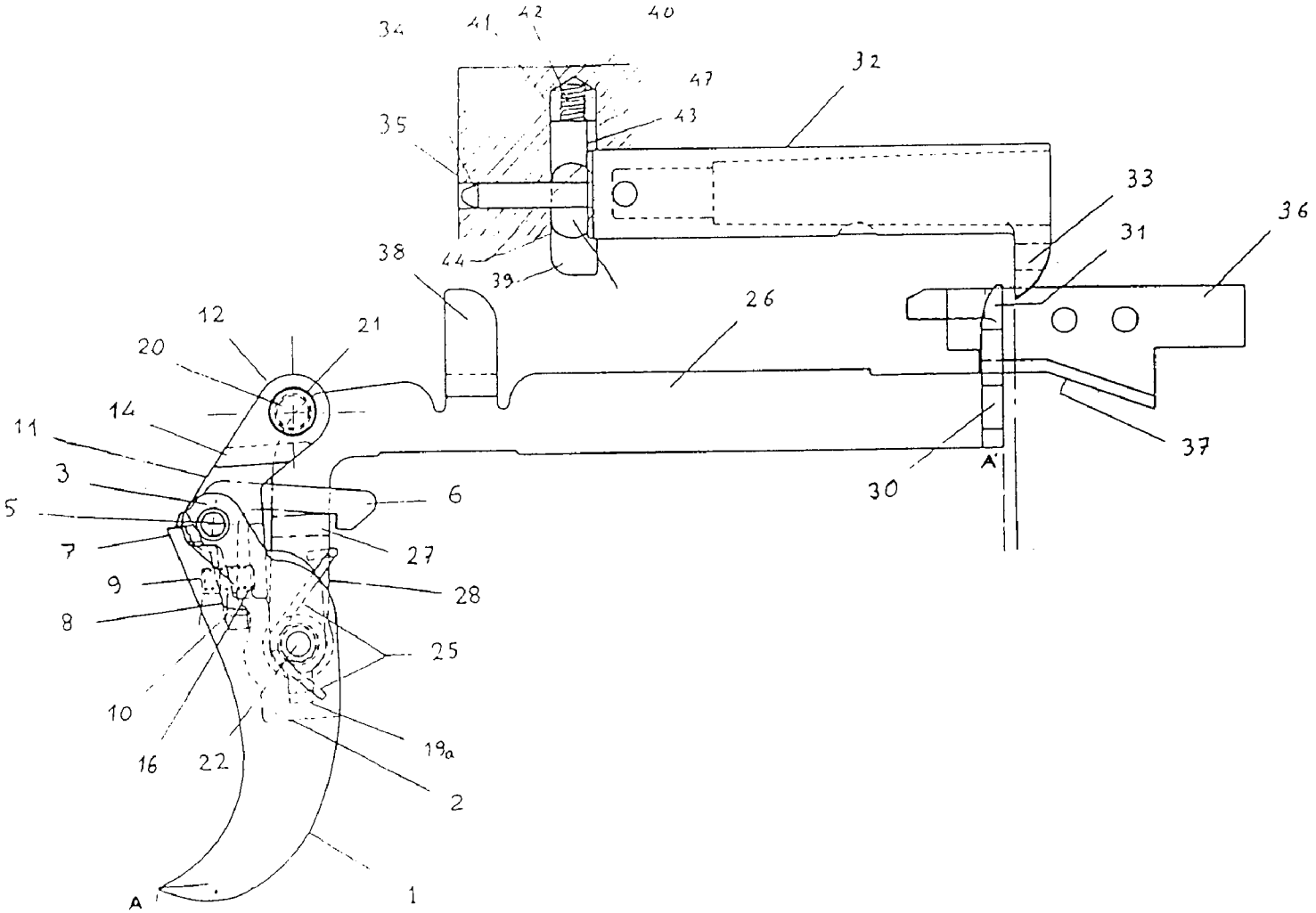
FIG. 3 is a side view just of the shooting mechanism, represented with relation to the command plate of the insert and the firing pin, with its lock in the resting position A of the trigger.

On the other hand, in FIG. 3, the shooting system is represented isolated from the insert (49), just keeping reference to the firing pin (32), the respective lock (39) and the plate (36) of said insert, which guides the movements of the trigger bar (26).

In this figure, positions A of the lower end of the trigger (1) and A' of the rear face of the vertical fastener (30) of the trigger bar and its edge (31) are clearly represented, the trigger ban edge (31) has a small course play in relation to the lower edge of the fastener (33) of the firing pin (32).

In the representation of the hinged set of the trigger, we can notice, in position A of the lower edge of the trigger body (1) that, by action of the spring (10), the trigger is maintained slightly displaced ahead of the trigger support (11). This small angular forward displacement of the trigger body (1) is made with relation to the axle (5) of its articulation with the respective support (11). Said support (11), is hinged in the insert (49) by means of the main axle (20), and has its forward movements inhibited by the wall of the enclosure of said insert (49) itself.

We can notice in FIG. 3 the position turned down position of the horizontal arm of the trigger lock (6), whose lower fastener inhibits any retreat movement of the stirrup (27) of the trigger bar (26). Concerning the inward bend (30) of the rear end of said trigger bar (26), the respective plane higher edge is pressed against the start of the horizontal portion of the guide edge (37) of the plate (36) of the insert (49).

Figure 4:
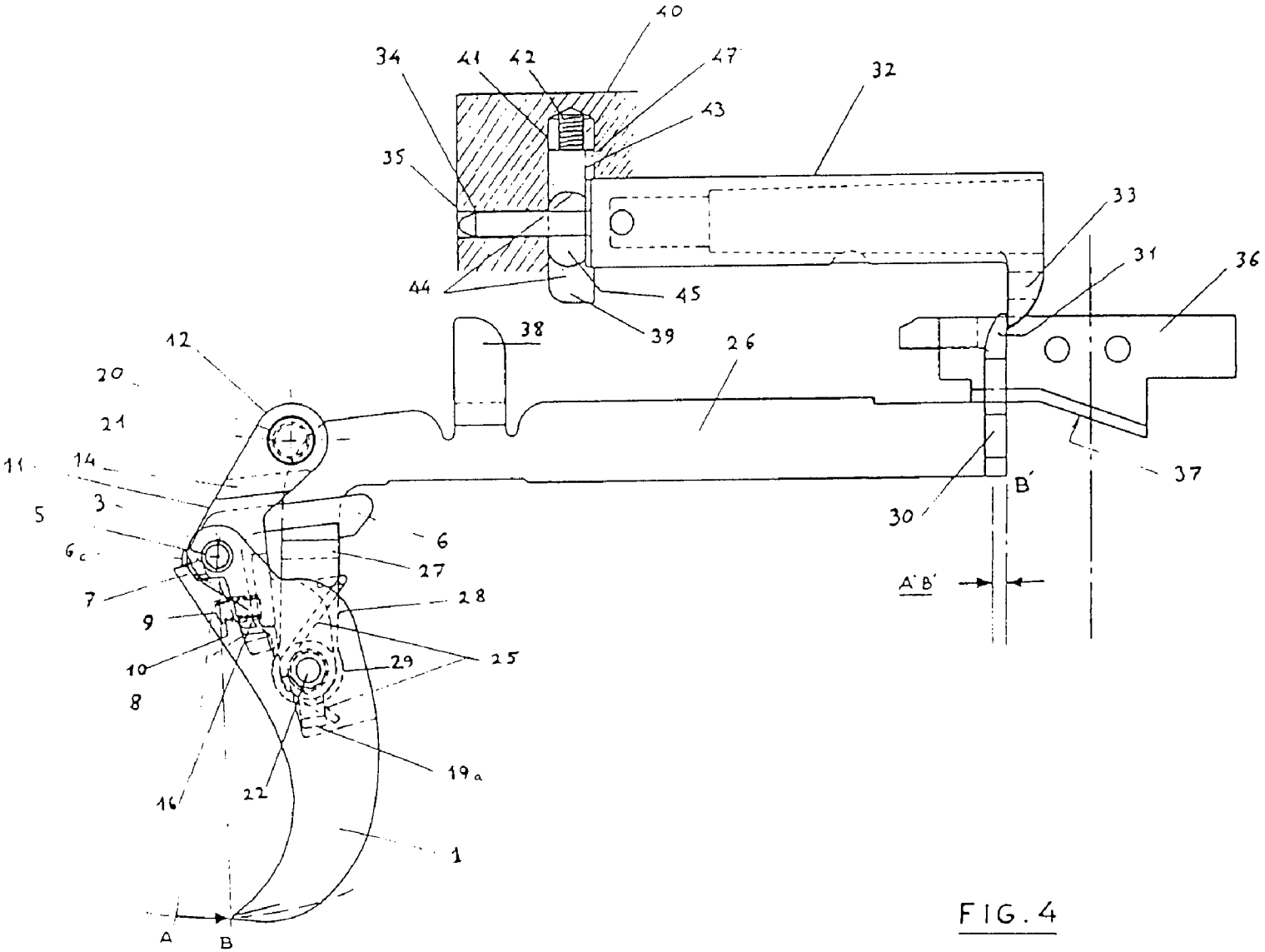
FIG. 4 is an identical view to FIG. 3, but starting pressure on the trigger, thus causing its slight angular displacement to position B, causing the trigger lock to release the trigger bar, enabling a small linear displacement A'B' of its fastener, until abutting the lower projection of the firing pin.

In FIG. 4, the trigger (1), when deliberately pressed for shooting, turns to position B, pressing the small spring (10) against the trigger support (11).

This small turn AB of the trigger (1) in relation to the hinging axle (5) with its support (11) raises the arm of the lock (6), disengaging its fastener from the stirrup (27) of the trigger bar (26), releasing it to move backwards. From this small initial turn, the body of the trigger (1) and its support (11) will act jointly, since the stirrup (19*a*) of the wings (19) will remain supported on the back wall of the recess (2) of the trigger body (1). In the end of the initial AB turn of the trigger, the rear face (31) of the fastener (30) of the trigger bar slides the portion A'B' backwards horizontally to meet, enough to abut it over the front face of the fastener (33) of the firing pin (32).

Figure 5:
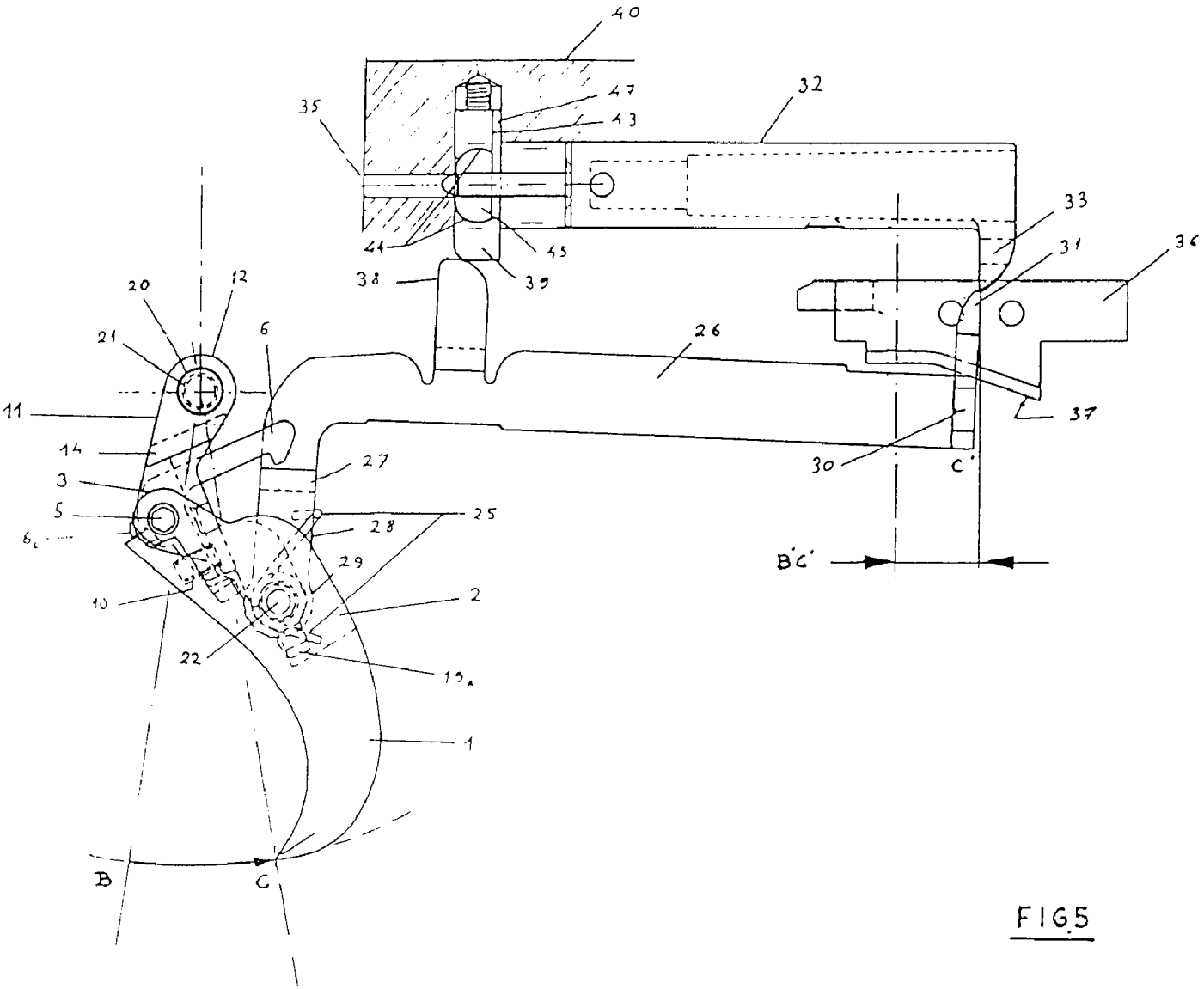
FIG. 5 is an identical view to FIGS. 3 and 4, with the trigger pressed to position C, determining the recession of the trigger bar, which presses the firing pin up to the limit position in which it is released for shooting, since the respective lock is deactivated by the protuberance of the trigger bar.

FIG. 5 shows that, as long as the deliberate pressure over the body (1) of the hinged set of the trigger, now joint, continues, the turn from point B to point C also continues, the same occurring with the round lower edge (29) of the front vertical arm (28) of the trigger bar (26), which is hinged by the axle (22) in the wings (19) of the trigger support (11), thus causing the backwards displacement of the trigger bar (26). These rotation BC and translation B'C' movements occur by actuating either the spring (25) of the trigger or the firing pin spring (32). The spring (25) also acts to maintain the rear edge (30) of the trigger bar (26) pressured upwards against the lower guide edge (37) of the plate (36), which, at the end of the recession B'C', forces a descending component into the movement of said edge (30) of the trigger bar and therefore the higher edge (31) of its fastener.

Position C' shows the release point of the higher edge (31) of the firing pin fastener (33). After released, the firing pin (32) immediately returns forwards, reaching its maximum advance point, in which it causes the firing. This is possible because the lock (39) of the firing pin (32) is deactivated when pressured upwards by the higher edge of the command (38) of the trigger bar (26) in its receded position. This backwards movement of the set of trigger and trigger bar is interrupted by a stop in the recess (49).

The lock (39) usually remains lowered in its enclosure (41) of the breechblock (40) by action of the spring (42) up to the limit position in which its protuberance (48) (FIG. 6) is intercepted by a stop of the breechblock. In that lowered position of the lock (39), the front portion of the firing pin (32) is on the stop constituted of the vertical face (43) of the lock body. Any forward movement of said firing pin (32) is therefore inhibited; the cylindrical body of the firing pin is tangent to the narrow vertical plane face (47) of the lock body (39). This narrow plane face (47) is perpendicular to the stop face (43) and also tangent to the cylindrical recess means (45) of the lock body (39).

When the shooter wishes to fire again, he should allow the return of the trigger to its resting position A, in which, the locking against accidental shots is also activated.

In the case of a fall of a gun with no safety trigger, when it hits the rear part violently on the floor, metal components of the shooting mechanism, such as the firing pin (32) and the trigger bar (26) are launched backwards by inertia with enough energy to tension the respective springs.

When this effect ends, said springs will expand and force said components to move forwards with enough energy to cause a shot.

In the safety device of the shooting mechanism of the present patent, this cannot happen since, even in the case of fall as mentioned, the lock (6) will remain with its fastener engaged to the stirrup (27), thus inhibiting any backwards movement of the respective trigger bar (26) and consequently the deactivation by its protuberance (38) of the lock (39) of the firing pin (32), which will remain immobilized. Even though the lock is joined to trigger, the immobilization occurs because the trigger is made of light plastic and also because it is kept forward by the spring (10) in the support (11). Therefore, the action of inertia over the trigger body (1) is negligible and the proposed system is assured against said accidental shots for fall of the gun with impact over its rear portion.

What is claimed:

1. Safety device for shooting mechanism of semi-automatic striker fired pistols, comprising:

a trigger assembly comprising a trigger support (11) and a trigger body (1) hinged to the trigger support around a common axle (5) allowing relative angular displacement of the trigger body relative to the trigger support, and a trigger spring (10) located between the trigger body and the trigger support, wherein the trigger assembly is pivotable about a main axle (20);

a lock (6) joined to the trigger body (1) so that in a rest position of the trigger body relative to the trigger support, the lock (6) immobilizes the shooting mechanism, the trigger assembly being biased forwards around the main axle (20) by a trigger return spring (25), whereby application of a turning force to the trigger body toward a shooting position first causes pivot around the common axle, which releases the lock and the shooting mechanism, and then fires the shooting mechanism.

2. The device of claim 1, further comprising a trigger bar (26) having a vertical projection (28), the trigger return spring also acting on the vertical projection (28), and wherein the shooting mechanism has a firing pin (32) and a lock (39) which blocks any advance of the firing pin (32) until deactivated by a protuberance (38) of the trigger bar (26) when the trigger bar (26) moves by action of the trigger body (1) and the trigger support (11) when deliberately pressed to a shooting position.

3. The device of claim 1, wherein the trigger body is made of plastic and the trigger support is made of metal.

4. The device of claim 1, wherein further pivot of the trigger assembly after release of the lock (6) is around the main axle.

5. The device of claim 4, wherein the shooting mechanism comprises a trigger bar and a firing pin, and wherein the trigger body (1), when pressed toward the shooting position, initially executes a small angular backwards movement relative to the trigger support (11), thereby releasing the lock (6), and then executes movement of the trigger bar (26), which will move the firing pin (32) backwards for firing.

* * * * *